US006440579B1

(12) United States Patent
Hauser et al.

(10) Patent No.: US 6,440,579 B1
(45) Date of Patent: Aug. 27, 2002

(54) PROCESS FOR PRODUCING A DRAWN WIRE MADE OF STAINLESS STEEL, IN PARTICULAR A WIRE FOR REINFORCING TIRES, AND WIRE OBTAINED BY THE PROCESS

(75) Inventors: Jean-Michel Hauser, Ugine; Joël Marandel, Varennes Vauzelles; Etienne Havette, Albertville, all of (FR)

(73) Assignees: Ugine Savoie Societe de Production Internationale de Trefiles, Ugine; Sprint Metal, Puteaux, both of (FR)

( * ) Notice: Subject to any disclaimer, the term of this patent is extended or adjusted under 35 U.S.C. 154(b) by 0 days.

(21) Appl. No.: 09/025,471

(22) Filed: Feb. 18, 1998

(30) Foreign Application Priority Data

Feb. 18, 1997 (FR) ..... 97 01858

(51) Int. Cl.[7] ..... B21C 37/04

(52) U.S. Cl. ..... 428/607; 148/504; 148/506; 148/597; 148/598; 148/599; 420/45; 420/49; 420/57; 420/58; 420/60; 420/61; 420/91; 420/97; 420/119; 420/120; 428/606; 428/615; 428/655; 428/656; 428/668; 428/677; 428/923

(58) Field of Search ..... 428/606, 607, 428/615, 655, 656, 668, 677, 923; 148/500, 503, 504, 506, 597, 598, 599, 226; 420/45, 49, 57, 58, 60, 61, 91, 97, 119, 120

(56) References Cited

U.S. PATENT DOCUMENTS 5,651,937 A * 7/1997 Descaves ..... 420/49

FOREIGN PATENT DOCUMENTS

| | | | |
|---|---|---|---|
| EP | 0 567 365 | 10/1993 | |
| EP | 0 648 891 | 4/1995 | |
| EP | 0 738 783 | 10/1996 | |
| FR | 2 333 864 | 7/1977 | |
| GB | 498726 | * 1/1938 | ..... 420/49 |

* cited by examiner

*Primary Examiner*—Deborah Jones
*Assistant Examiner*—Robert R. Koehler
(74) *Attorney, Agent, or Firm*—Oblon, Spivak, McClelland, Maier & Neustadt, P.C.

(57) ABSTRACT

Process for producing a drawn wire, in particular a wire for reinforcing tires, having a diameter of less than 0.3 mm by drawing a base wire rod having a diameter of greater than 5 mm or a predrawn base wire made of steel with the following composition by weight:

carbon $\leqq 40\times10^{-3}\%$
nitrogen $\leqq 40\times10^{-3}\%$, the carbon and nitrogen satisfying the relationship $C+N \leqq 50\times10^{-3}\%$, $0.2\% \leqq$ silicon $\leqq 1.0\%$,
$0.2\% \leqq$ manganese $\leqq 5\%$,
$9\% \leqq$ nickel $\leqq 12\%$,
$15\% \leqq$ chromium $\leqq 20\%$,
$1.5\% \leqq$ copper $\leqq 4\%$,
sulfur $\leqq 10\times10^{-3}\%$,
phosphorus $<0.050\%$,
$40\times10^{-4}\% \leqq$ total oxygen $\leqq 120\times10^{-4}\%$,
$0.1\times10^{-4}\% \leqq$ aluminum $\leqq 20\times10^{-4}\%$,
magnesium $\leqq 5\times10^{-4}\%$,
$0.1\times10^{-4}\% \leqq$ calcium $\leqq 5\times10^{-4}\%$,
titanium $\leqq 50\times10^{-4}\%$,
impurities inherent in the manufacture, in which steel the inclusions of oxides have, in the form of a glassy mixture, the following proportions by weight:

$30\% \leqq SiO_2 \leqq 65\%$,
$5\% \leqq MnO \leqq 40\%$,
$1\% \leqq CaO \leqq 30\%$,
$0\% \leqq MgO \leqq 10\%$,
$3\% \leqq Al_2O_3 \leqq 25\%$,
$0\% \leqq Cr_2O_3 \leqq 10\%$.

29 Claims, 2 Drawing Sheets

PROCESS FOR PRODUCING A DRAWN WIRE MADE OF STAINLESS STEEL, IN PARTICULAR A WIRE FOR REINFORCING TIRES, AND WIRE OBTAINED BY THE PROCESS

FIELD OF THE INVENTION

The present invention relates to a process for producing a drawn wire, made of stainless steel, in particular a wire for reinforcing tires, having a diameter of less than 0.3 mm, by drawing a steel having a suitable composition and a suitable quality in terms of inclusions. The wire obtained by the process can be used in the field of the production of components subjected to fatigue.

Metal wire for reinforcing the elastomers in tires must have a small diameter, generally between 0.1 mm and 0.3 mm, and high mechanical properties. The tensile strength may be greater than 2300 MPa, the residual ductility, measured by the reduction in cross section in tension or torsion or by a wrap-around test, must be non-zero and the fatigue endurance limit, in rotary or alternating flexure, must be greater than 1000 MPa.

These characteristics are necessary for withstanding the static and alternating loads to which the wire is subjected in the assemblies incorporated into tires.

Furthermore, the drawing of stainless steel wire down to a diameter of between 0.1 and 0.3 mm must be possible under industrial conditions, i.e. with breakage frequencies as low as possible, while limiting the expensive operations such as heat treatments and intermediate annealing steps.

PRIOR ART

It is known, for reinforcing tires, to use a stainless steel wire in the highly strain-hardened state resulting from the drawing process.

Patent Application FR 9 312 528 relates to the use of a stainless steel wire having a diameter of between 0.05 mm and 0.5 mm, the tensile strength $R_m$ of which is greater than 2000 MPa. The steel of which the wire is composed contains, in its composition, at least 50% of martensite obtained by drawing with a reduction ratio of greater than 2.11 and with intermediate annealing operations, the sum of the nickel and chromium contents being between 20% and 35%.

SUMMARY OF THE INVENTION

The subject of the invention is the production of a drawn wire, in particular a wire for reinforcing tires, having a diameter of less than 0.3 mm by drawing a base wire rod having a diameter of greater than or equal to 5 mm or a predrawn base wire made of steel of a given composition, the simplified production process ensuring, on the one hand, that the quality in terms of inclusions results in fewer breakages during drawing and, on the other hand, that the mechanical properties are improved.

The subject of the invention is a process for producing a drawn wire by drawing a base wire of stainless steel with the following composition by weight:

carbon $\leqq 40\times10^{-3}\%$ nitrogen $\leqq 40\times10^{-3}\%$, the carbon and nitrogen satisfying the relationship $C+N\leqq 50\times10^{-3}\%$, $0.2\%\leqq$ silicon $\leqq 1.0\%$, $0.2\%\leqq$ manganese $\leqq 5\%$, $9\%\leqq$ nickel $\leqq 12\%$, $15\%\leqq$ chromium $\leqq 20\%$, $1.5\%\leqq$ copper $\leqq 4\%$, sulfur $\leqq 10\times10^{-3}\%$, phosphorus $<0.050\%$, $40\times10^{-4}\%\leqq$ total oxygen $\leqq 120\times10^{-4}\%$, $0.1\times10^{-4}\%\leqq$ aluminum $\leqq 20\times10^{-4}\%$, magnesium $\leqq 5\times10^{-4}\%$, $0.1\times10^{-4}\%\leqq$ calcium $\leqq 5\times10^{-4}\%$, titanium $\leqq 50\times10^{-4}\%$, impurities inherent in the manufacture, in which steel the inclusions of oxides have, in the form of a glassy mixture, the following proportions by weight:

$30\%\leqq SiO_2\leqq 65\%$, $5\%\leqq MnO\leqq 40\%$, $1\%\leqq CaO\leqq 30\%$, $0\%\leqq MgO\leqq 10\%$, $3\%\leqq Al_2O_3\leqq 25\%$, $0\%\leqq Cr_2O_3\leqq 10\%$, the composition satisfying the following relationships:

when Si Mn<2%;

IM=551−462*(C %+N %)−9.2*Si %−8.1*Mn %−13.7*Cr %−29*(Ni %+Cu %)−18.5*Mo %, with

150° C.<IM<−55° C., and when

Si Mn≧2%;

JM=551−462*(C %+N %)−9.2*Si %−20*Mn %−13.7*Cr %−29*(Ni %+Cu %)−18.5*Mo %, with

−120° C.<JM<−55° C., which base wire undergoes drawing satisfying the following drawing conditions:

a cumulative deformation ratio $\epsilon$ of greater than 6, the wire is held, during the drawing and between the drawing operations, at a temperature of less than 650° C., and preferably less than 600° C., without annealing between the drawing passes.

The other characteristics of the invention are:

before the drawing operation, the initial base wire undergoes annealing called overhardening at a temperature of greater than 650° C.;

the composition includes less than $5\times10^{-3}\%$ of sulfur;

the composition includes from 3% to 4% of copper;

the composition furthermore includes less than 3% of molybdenum;

a wire having a diameter of less than 0.2 mm is drawn;

the drawing is carried out with a deformation ratio $\epsilon$ of greater than 6.6;

the wire furthermore undergoes a brass-plating operation before or between the drawing operations;

the base wire rod having a diameter of greater than 5 mm contains less than 5 oxide inclusions with a thickness of greater than 10 $\mu$m over an area of 1000 $mm^2$;

the base wire rod having a diameter of greater than 5 mm contains less than 10 sulfide inclusions with a thickness of greater than 5 $\mu$m over an area of 1000 mm2.

The invention likewise relates to the stainless steel used in the process.

The invention also relates to the application of the wire obtained by the process in the tire-reinforcement field.

The description which follows and the appended figures, all given by way of non-limiting example, will make the invention clearly understood.

DESCRIPTION OF THE PREFERRED EMBODIMENTS

Figure 1:
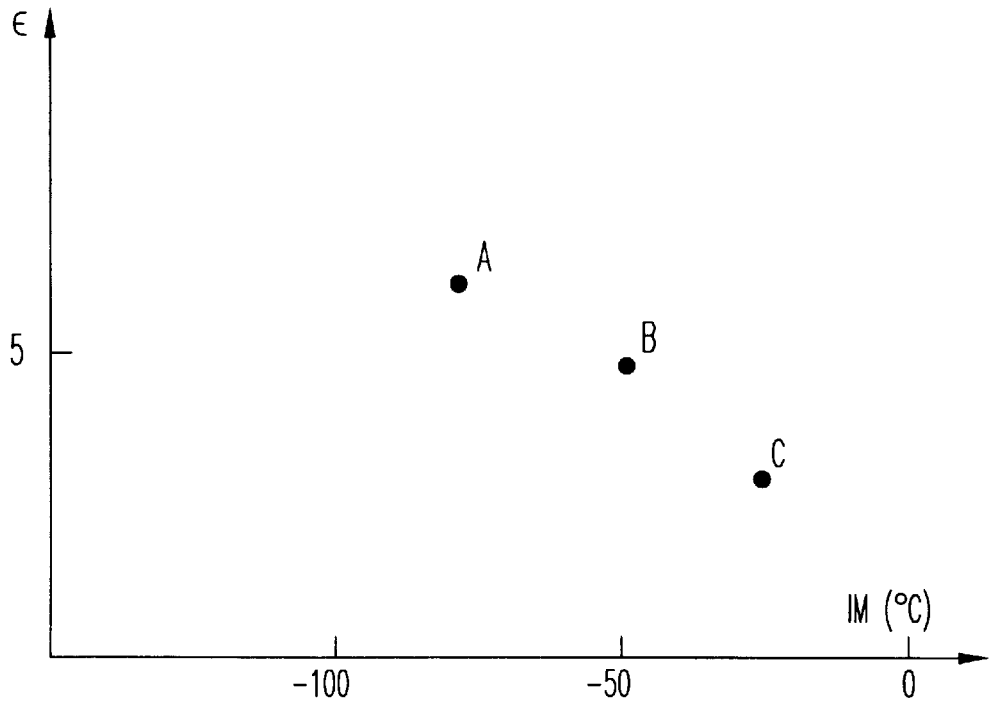
FIG. 1 shows the cumulative deformation ratio $\epsilon$ that it is possible to attain by industrial drawing, without annealing between the drawing operations, as a function of the IM index defined by the relationship satisfying the composition for alloys containing less than 2% of manganese.

The invention relates to a process for producing a drawn wire, in particular a wire for reinforcing tires, having a diameter of less than 0.3 mm by drawing a base wire rod having a diameter of greater than 5 mm or a predrawn base wire.

The drawing of a stainless reinforcing wire, the diameter of which varies between 0.1 and 0.3 mm, must satisfy an in-service performance requirement from the standpoint of flexural, tensile or torsional fatigue, as well as a strength requirement in a wet environment or in a combined stress state of a wet environment and fatigue.

The fine wire is produced by drawing a steel wire rod or a predrawn steel wire. Because of the composition of the steel, the final drawn wire, has after direct drawing without intermediate annealing, improved tensile strength properties and a residual ductility sufficient for it to be assembled, for example, in the form of plies or cables.

According to the invention, the drawing is carried out using a stainless steel with the following composition by weight:

carbon $\leqq 40\times10^{-3}\%$ nitrogen $\leqq 40\times10^{-3}\%$, the carbon and nitrogen satisfying the relationship $C+N\leqq 50\times10^{-3}\%$ $0.2\%\leqq$ silicon $\leqq 1.0\%$, $0.2\%\leqq$ manganese $\leqq 5\%$, $9\%\leqq$ nickel $\leqq 12\%$, $15\%\leqq$ chromium $\leqq 20\%$, $1.5\%\leqq$ copper $\leqq 4\%$, sulfur $\leqq 10\times10^{-3}\%$, phosphorus $\leqq 0.050\%$, $40\times10^{-4}\%\leqq$ total oxygen $\leqq 120\times10^{-4}\%$, $0.1\times10^{-4}\%\leqq$ aluminum $\leqq 20\times10^{-4}\%$, magnesium $\leqq 5\times10^{-4}\%$, $0.1\times10^{-4}\%\leqq$ calcium $\leqq 5\times10^{-4}\%$, titanium $\leqq 50\times10^{-4}\%$, impurities inherent in the manufacture, in which steel the inclusions of oxides have, in the form of a glassy mixture, the following proportions by weight:

$30\%\leqq SiO_2\leqq 65\%$, $5\%$ $MnO\leqq 40\%$, $1\%\leqq CaO\leqq 30\%$, $0\%\leqq MgO\leqq 10\%$, $3\%$ $Al_2O_3\leqq 25\%$, $0\%\leqq Cr_2O_3\leqq 10\%$.

This steel, the austenite of which is partially converted into martensite by deformation near ambient temperature, having controlled inclusions, makes it possible to achieve a cumulative deformation $\epsilon$ by drawing, without intermediate annealing, of greater than 6.84. The expression cumulative deformation $\epsilon$ by drawing is understood to mean the value of the natural logarithm of the ratio of the initial cross section to the final cross section ($\epsilon=\log[So/Sf]$).

According to the invention, the composition satisfies the following relationships:

when Si Mn<2%;

$IM=551-462*(C\ \%+N\ \%)-9.2*Si\ \%-8.1*Mn\ \%-13.7*Cr\ \%-29*(Ni\ \%+Cu\ \%)-18.5*Mo\ \%$, with $-150°\ C.<IM<-55°\ C.$, and when Si Mn≧2%;

$JM=551-462*(C\ \%+N\ \%)-9.2*Si\ \%-20*Mn\ \%-13.7*Cr\ \%-29*(Ni\ \%+Cu\ \%)-18.5*Mo\ \%$, with $-120°\ C.<JM<-55°\ C.$ This composition condition is intended to achieve large reductions by drawing and suitable hardening by strain hardening.

The base wire undergoes drawing satisfying the following drawing conditions:

a cumulative deformation ratio $\epsilon$ of greater than 6, the wire is held, during the drawing and between the drawing operations, at a temperature of less than 650° C., and preferably less than 600° C., without annealing between the drawing passes.

Without annealing means that there is no reheating of the wire above 650° C. between the start and finish of the drawing operations. Annealing above 650° C. would have the effect of converting the martensite into austenite and of eliminating the recrystallization strain hardening.

The wire is preferably drawn on a multipass machine, the wire being, on the one hand, lubricated with soap or with a liquid lubricant and, on the other hand, temperature-controlled between 20° C. and 180° C.

The wire may also be brass-coated before or during the drawing operations. The brass layer improves the drawability and the adhesion of the wire to the elastomers used in tires.

From the metallurgical standpoint, it is known that certain alloying elements present in the composition of steels promote the appearance of the ferrite phase which has a metallographic structure of the body-centered cubic type. These elements are called alphagens. Among these are chromium, molybdenum and silicon.

Other elements, called gammagens, promote the appearance of the austenitic phase which has a metallographic structure of the face-centered cubic type. Among these are carbon, nitrogen, manganese, copper and nickel.

It has been observed that the compositions forming an excessive amount of martensite at drawing become brittle and break during drawing. This maximum amount of martensite depends on the total carbon and nitrogen content of the steel and is about 90% for a total carbon and nitrogen content of less than 0.030%, about 70% for a total carbon and nitrogen content of less than or equal to 0.050% and about 30% for a total carbon and nitrogen content of between 0.050% and 0.1%.

According to the invention, the steel has a carbon and nitrogen content of less than or equal to 0.050%, the drawing conditions satisfying the following relationships:

when Si Mn<2%;

$IM=551-462*(C\ \%+N\ \%)-9.2*Si\ \%-8.1*Mn\ \%-13.7*Cr\ \%-29*(Ni\ \%+Cu\ \%)-18.5*Mo\ \%$, with −150° C.<IM<−55° C., and when Si Mn≧2%;

JM=551−462*(C %+N %)−9.2*Si %−20*Mn %−13.7*Cr %−29*(Ni %+Cu %)−18.5*Mo %, with

−120° C.<JM<−55° C.

It has also been observed that the compositions having an IM index greater than the value defined above and a total carbon and nitrogen content of about 0.040% become brittle before being able to be drawn down to the final diameter.

Likewise, the presence of an excessive amount of silicon, i.e. in an amount greater than 1%, has the effect of embrittling the wire in the strain-hardened state resulting from drawing in the presence of a large amount of martensite.

The composition of the stainless steel according to the invention, containing more than 9% of nickel, more than 1.5% of copper, more than 15% of chromium, a total carbon and nitrogen content of less than 0.050%, an Mn content of less than 2% with an IM index of less than −55° C. or an Mn content of greater than or equal to 2% with a JM index of less than −55° C., may be drawn down to the final diameter with a reduced rate of breakage, the wire maintaining mechanical properties which allow it to be used in the tire-reinforcement field.

When the Mn content is less than 2%, the IM index must lie within the range −150° C. and −55° C. This is because if IM is less than −150° C., the amount of martensite formed remains small, for example, less than 10%, and the tensile strength cannot reach high values, greater than 2200 MPa, even after drawing with a cumulative deformation $\epsilon$ close to 8. In the same way, when the Mn content is greater than or equal to 2%, the JM index must lie between −120° C. and −55° C. When JM is less than −120° C., the amount of martensite is less than 25% and the tensile strength may not exceed 2200 MPa even after a cumulative reduction of about 8.

This observation justifies the less than 20% limit in the chromium content and the less than 16% limit in the total copper and nickel content.

A copper content greater than 4% causes segregations during solidification and causes fractures or defects during hot rolling.

The process applied to the drawing of the stainless steel according to the invention makes it possible to obtain a wire having excellent fatigue behavior measured by rotary flexure together with a $2\times10^6$ cycle endurance stress of greater than 1000 MPa.

The wire obtained contains less than 75% of austenite or more than 25% of martensite. The steel used, having a total carbon and nitrogen content of less than 0.050%, is in a state in which the austenite is slightly unstable.

In order to obtain a tensile strength of about 2400 MPa, it is necessary to have a base wire of high quality in terms of inclusions.

This is because, in the wire-drawing field, it is known that in order to obtain a wire having a so-called fine diameter of less than 0.3 mm, starting from the drawing of a wire rod or from a predrawn base wire, the stainless steel used must not have any inclusions whose size will cause the wire to break during drawing.

In the production of austenitic stainless steels, as for all other steels produced using conventional means and economically suited to mass-production, inclusions of the sulfide or oxide type occur systematically and irremediably. This is because stainless steels in the liquid state may, owing to the production processes, contain oxygen and sulfur in solution with contents of less than $1000\times10^{-4}$%. When cooling the steel, in the liquid or solid state, the solubility of the oxygen and sulfur elements decreases and the energy of formation of oxides and sulfides is reached. Inclusions therefore appear, these being formed, on the one hand, by compounds of the oxide type, containing oxygen atoms and alloy elements avid to react with oxygen, such as calcium, magnesium, aluminum, silicon, manganese and chromium, and, on the other hand, by compounds of the sulfide type, containing sulfur atoms and alloy elements avid to react with sulfur, such as manganese, chromium, calcium and magnesium. Inclusions may also appear which are mixed compounds of the oxysulfide type.

It is possible to reduce the amount of oxygen contained in stainless steel by using powerful reducing agents such as magnesium, aluminum, calcium or titanium or a combination of several of these, but these reducing agents all lead to the formation of inclusions rich in MgO, $Al_2O_3$, CaO or $TiO_2$ which, under the conditions of rolling of stainless steel, are in the form of hard and undeformable crystallized refractories. The presence of these inclusions causes drawing problems and fatigue fractures in products produced from stainless steel.

According to the invention, the production of a stainless steel having a selected low level of inclusions makes it possible to produce a wire rod or predrawn base wire, the wire used according to the invention to draw a wire for reinforcing tires having a diameter of less than 0.3 mm, or to produce components subjected to fatigue.

The invention relates to a stainless steel which has inclusions of oxides in the form of a glassy mixture, the proportions by weight of these being as follows:

$30\% \leqq SiO_2 \leqq 65\%$, $5\% \leqq MnO \leqq 40\%$, $1\% \leqq CaO \leqq 30\%$, $0\% \leqq MgO \leqq 10\%$, $3\% \leqq Al_2O_3 \leqq 25\%$, $0\% \leqq Cr_2O_3 \leqq 10\%$.

In one example of an application of the invention, a steel A according to the invention contains in its composition by weight $19\times10^{-3}$% of carbon, $23\times10^{-3}$% of nitrogen, 0.53% of silicon, 0.72% of manganese, 17.3% of chromium, 9.3% of nickel, 3.1% of copper, 0.055% of molybdenum, $4\times10^{-3}$% of sulfur, $22\times10^{-3}$% of phosphorus, $72\times10^{-4}$% of total oxygen, $5\times10^{-4}$% of total aluminum, $2\times10^{-4}$% of magnesium, $2\times10^{-4}$% of calcium and $11\times10^{-4}$% of titanium. Its IM stability index is −77° C. The steel is smelted in an electric furnace and then in an AOD converter, and is cast continuously with a cross section of 205 mm by 205 mm and then hot-rolled into wire 5.5 mm in diameter.

At this stage in the process, steel A was subjected to metallographic examination, by cutting along the longitudinal direction, which revealed the presence, over an area of 1000 $mm^2$, of 8 inclusions having a thickness of between 5 and 10 $\mu$m and one inclusion of 12 $\mu$m.

After recrystallization annealing at 1050° C. in coiled form and then water cooling, the wire is pickled and then drawn, without intermediate annealing, down to a diameter of 0.18 mm successively on several multipass machines. The tensile strength of the drawn wire is then 2650 MPa and the wire has a reduction in cross section after tensile testing.

It has been found that base wires having a diameter of 5.5 mm of composition B and C, which are given below in Table 1, could not be drawn without excessive embrittlement and fractures, the embrittlement resulting from the absence of a reduction in cross section in tensile testing.

TABLE 1

| Steel | C | N | Si | Mn | Ni | Cr | Cu | Mo | S | P | O $10^{-4}$ | Al $10^{-4}$ | Mg $10^{-4}$ | Ca $10^{-4}$ | Ti $10^{-4}$ |
|---|---|---|---|---|---|---|---|---|---|---|---|---|---|---|---|
| | Composition of the steel in % by weight | | | | | | | | | | | | | | |
| A | 0.019 | 0.023 | 0.53 | 0.72 | 9.3 | 17.3 | 3.1 | 0.055 | 0.004 | 0.022 | 72 | 5 | 2 | 2 | 11 |
| B | 0.036 | 0.022 | 0.37 | 1.22 | 9.4 | 18.4 | 0.22 | 0.25 | 0.003 | 0.023 | 26 | 43 | 5 | 9 | 17 |
| C | 0.011 | 0.027 | 0.42 | 1.83 | 8.1 | 17.2 | 3.2 | 0.036 | 0.004 | 0.025 | 42 | 25 | 3 | 6 | 63 |

In the case of drawing wires having compositions B and C, it was only possible to obtain wires having, respectively, diameters greater than or equal to 1.0 mm and 0.4 mm.

This finding is demonstrated in terms of the cumulative deformation $\epsilon$ and the stability index IM in Table 2, in the case of direct drawing of a 5.5 mm base wire, without annealing during drawing and without a high number of breakages.

TABLE 2

| Steel | IM ° C. | Drawn diameter mm | $\epsilon$ | Tensile strength MPa | % martensite in drawn wire |
|---|---|---|---|---|---|
| A | −77 | 0.18 | 6.84 | 2350 | 68 |
| B | −26 | 1.0 | 3.41 | 1980 | 30 |
| C | −49 | 0.4 | 5.24 | 2400 | 72 |

Steel B cannot be used to draw fine wire having a diameter of less than 0.3 mm directly from a diameter of 5.5 mm. Its stability index IM is high and also its combined carbon and nitrogen content gives it a brittle character when it is drawn below a diameter of 1 mm.

Steel C can be drawn down to a diameter of 0.4 mm from a wire having a diameter of 5.5 mm. For higher draw ratios, it becomes brittle with the presence of a large amount of martensite in its composition.

Steel A according to the invention can be drawn from 5.5 mm down to 0.18 mm without the process inducing brittleness in the wire obtained. The wire thus produced has a tensile strength which ensures that it can be used in the field of wire for reinforcing tires.

In another example of wire drawing, annealed wires having a diameter of 5.5 mm are used, the compositions of which are given in Table 3.

TABLE 3

| Steel | C | N | Si | Mn | Ni | Cr | Cu | Mo | S | P |
|---|---|---|---|---|---|---|---|---|---|---|
| D | 0.011 | 0.016 | 0.35 | 0.54 | 9.48 | 17.1 | 3.16 | 0.19 | 0.002 | 0.027 |
| E | 0.017 | 0.015 | 0.34 | 3.85 | 9.52 | 17.5 | 3.16 | 0.19 | 0.003 | 0.025 |
| F | 0.020 | 0.015 | 0.34 | 3.86 | 10.5 | 18.9 | 3.13 | 0.19 | 0.001 | 0.024 |
| G | 0.019 | 0.014 | 0.36 | 3.84 | 8.47 | 17.1 | 3.12 | 0.2 | 0.003 | 0.026 |

The wires were drawn in 12 successive passes using soap down to a diameter of 1 mm, then in 6 passes using soap down to a diameter of 0.48 mm and then in 9 passes using soap down to a diameter of 0.18 mm, all this without any annealing from the initial state. At this stage, the end product was subjected to tensile measurements and to measurements of the martensite content using the saturation magnetization method.

Table 4 shows, for each of the compositions, the values of the IM and JM indices, as well as the tensile strengths $R_m$ and the martensite contents of the end product.

TABLE 4

| Steel | IM | JM | $R_m$ (MPa) | Martensite |
|---|---|---|---|---|
| D | −74 | −81 | 2644 | 90% |
| E | −110 | −156 | 1810 | 4.4% |
| F | −159 | −205 | 1791 | 1.2% |
| G | −73 | −119 | 2072 | 27% |

Figure 2:
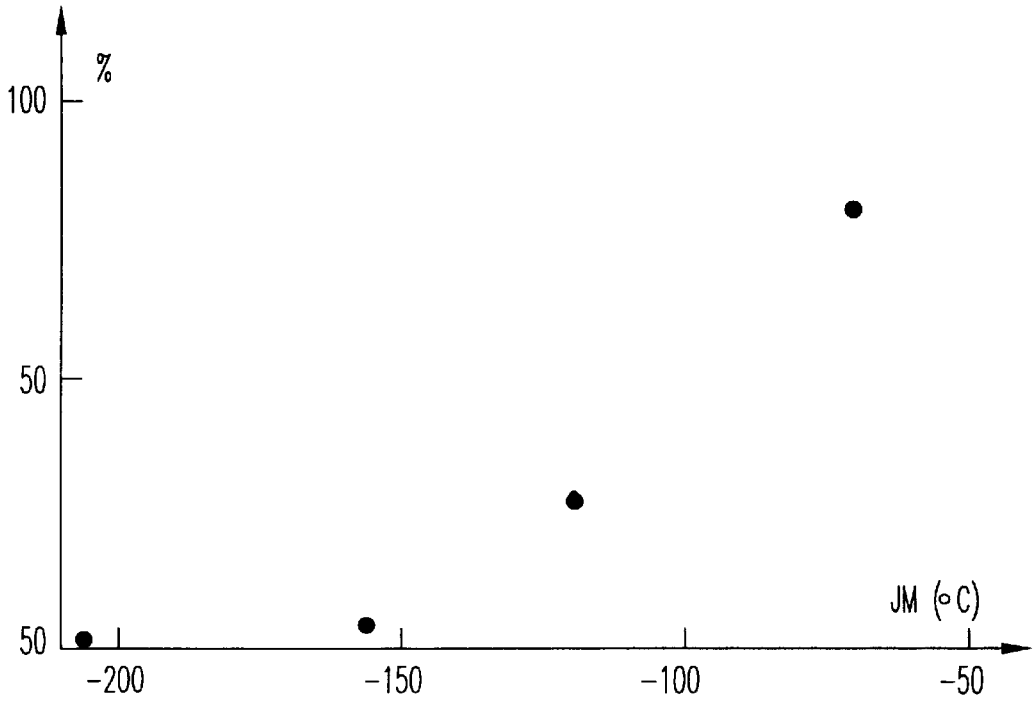
FIG. 2 shows the martensite content, after drawing the 5.5 mm diameter down to 0.18 mm diameters, without intermediate annealing, of annealed wires of various compositions as a function of the JM index.

FIG. 2 shows the martensite content of the 0.18 mm diameter wires as a function of JM.

Figure 3:
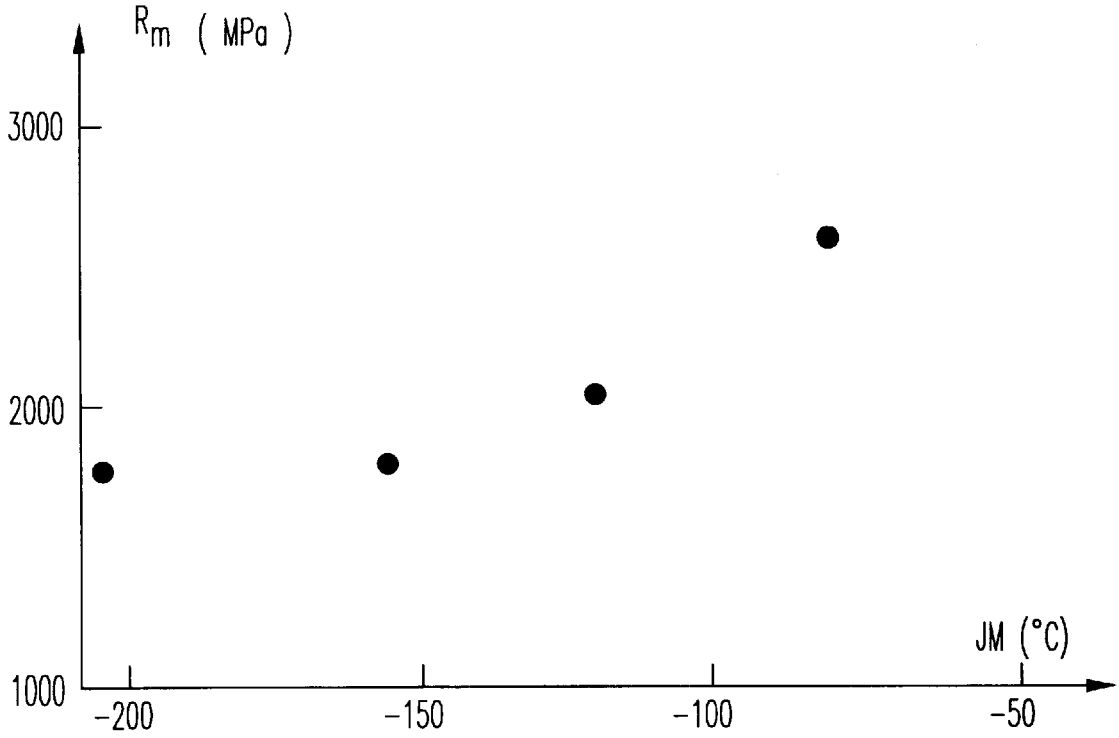
FIG. 3 shows the tensile strength after drawing 5.5 mm down to 0.18 mm, without intermediate annealing, as a function of the index JM.

FIG. 3 shows the tensile strengths of the 0.18 mm diameter wires as a function of JM.

The JM index is particularly pertinent for giving an account of the variation in the tensile strengths and the martensite contents.

Wires having a JM index of less than −120° C. will have, after heavy drawing corresponding to $\epsilon$=6.84 without intermediate annealing, low tensile strengths, i.e. less than 2200 MPa.

Wires having a JM index greater than −55° C. will have, for draw ratios $\epsilon$ above 6, without intermediate annealing, more than 90% martensite and will exhibit brittle behavior.

In a third example of application, an annealed wire having an initial diameter of 5.5 mm of steel D, the composition of which is given in Table 3, was used.

The wires were drawn in 12 passes, using soap, down to a diameter of 1 mm, without intermediate annealing. Various treatments were carried out on this 1 mm diameter wire at temperatures lying between 500° C. and 700° C. for total durations of 2.5 seconds to 10 seconds. Such treatments may be required after electrolytically depositing thin copper or zinc layers, in order to obtain, via diffusion, a homogeneous layer of brass, commonly used as a rubber-bonding layer in the manufacture of tires.

Next, the martensite contents of the lengths of heat-treated wires their tensile strength were measured. The measured values are given in Table 5, together with the values of the 1 mm untreated reference wire.

TABLE 5

| Heat treatment ° C. | Duration s | $R_m$ MPa | Martensite % |
|---|---|---|---|
| Untreated | | 1780 | 46 |
| 500 | 2.5 | | |
| | 5 | | |
| | 10 | 1899 | 48 |
| 550 | 2.5 | 1847 | 46 |
| | 5 | 1839 | 44 |
| | 10 | 1650 | 39 |
| 600 | 2.5 | 1677 | 37 |
| | 5 | 1502 | 27 |
| | 10 | 1409 | 18 |
| 650 | 2.5 | 1378 | 22 |
| | 5 | 1354 | 9 |
| | 10 | 1292 | 3 |

It is observed that, for temperatures of less than 550° C., the treatment substantially preserves the initial amount of martensite and may cause slight short-time hardening. At 600° C., and for a duration shorter than 2.5 seconds, a minor part of the martensite has disappeared and the wire has softened slightly. For a duration of 5 or 10 seconds at a temperature of 600° C., the softening becomes greater. At 650° C., the martensite tends mostly to disappear and the steel of the wire softens greatly.

From these examples, it is concluded that, in the process according to the invention, the wires could undergo, between several drawing operations, heat treatments at temperatures of less than 650° C., and preferably less than 600° C., without causing softening or an excessive loss of martensite which would prejudice the achievement of very high mechanical properties in the state in which the drawn wire has undergone a total drawing deformation $\epsilon$ of greater than 6. Conversely, any treatment, even a short treatment, at a temperature above 650° C. greatly softens the steel of the drawn wire at an intermediate or final stage, this being regarded as an annealing operation.

Carbon, nitrogen, chromium, nickel, manganese and silicon are the usual elements allowing formation of austenitic stainless steel.

The manganese, chromium and sulfur contents are chosen in proportion in order to produce deformable sulfides of well-defined composition.

In the case of silicon and manganese, the composition ranges of these elements in proportion, ensure that, according to the invention, silicate-type inclusions rich in $SiO_2$ and containing a not insignificant amount of MnO are present, these inclusions being able to deform during hot-rolling.

The silicon content is between 0.2%, which corresponds to the residual amount due to smelting, and 1%, which is the content above which excessive embrittlement appears in the strain-hardened drawn wire.

Molybdenum may be added to the composition of the stainless steel to improve the corrosion resistance. In one embodiment the composition includes less than 3% of molybdenum.

Copper is added to the composition of the steel according to the invention as it improves the cold-deformation properties and consequently stabilizes the austenite. However, the copper content is limited to 4% in order to avoid difficulties in hot conversion as copper significantly lowers the upper limit to which the steel may be reheated before rolling.

The total oxygen, aluminum and calcium ranges make it possible, according to the invention, to obtain inclusions of the manganese silicate type which contain a non-zero fraction of $Al_2O_3$ and CaO. In particular, the overall aluminum and calcium contents are each greater than $0.1\times10^{-4}$% so that the desired inclusions contain more than 1% of CaO and more than 3% of $Al_2O_3$.

The values of the total oxygen contents are, according to the invention, between $40\times10^{-4}$% and $120\times10^{-4}$%.

For a total oxygen content of less than $50\times10^{4}$%, the oxygen fixes the elements magnesium, calcium and aluminum and does not form oxide inclusions rich in $SiO_2$ and MnO.

For a total oxygen content of greater than $120\times10^{-4}$%, there is more than 10% of $Cr_2O_3$ in the oxide composition, which promotes the crystallization that it is sought to avoid.

The calcium content is less than $5\times10^{-4}$% so that the desired inclusions do not contain more than 30% of CaO.

The aluminum content is less than $20\times10^{-4}$% in order to avoid the desired inclusions containing more than 25% of $Al_2O_3$, which also promotes crystallization.

It is conceivable, after having produced a steel containing oxide-and-sulfide-type inclusions using a conventional and economic process, to refine it in order to make these inclusions disappear by using slow remelting processes which are economically not very efficient, such as the vacuum argon remelting process or the electroslag remelting process.

These remelting processes only allow partial elimination, by decantation in the flask of liquid, of the inclusions already present without modifying their nature or their composition.

The invention relates to a stainless steel containing inclusions of chosen composition obtained intentionally, the composition being in a relationship with the overall composition of the steel such that the physical properties of these inclusions favor their deformation during hot-conversion of the steel.

According to the invention, the stainless steel contains inclusions of defined composition which have their softening point close to the temperature at which the steel is rolled and are such that the appearance of crystals harder than the steel at the rolling temperature, such as, in particular, the defined compounds: $SiO_2$, in the form of tridymite, cristobalite and quartz; $3CaO—SiO_2$; CaO; MgO; $Cr_2O_3$; anorthite, mullite, gehlenite, corundum, spinels of the $Al_2O_3$—MgO or $Al_2O_3$—$Cr_2O_3$—MnO—MgO type; CaO—$Al_2O_3$; CaO—$6Al_2O_3$; CaO—$2Al_2O_3$; $TiO_2$ is inhibited.

According to the invention, the steel contains mainly oxide inclusions of composition such that it forms a glassy or amorphous mixture during all the successive steel-forming operations. The viscosity of the chosen inclusions is sufficient for the growth of the crystallized oxide particles in the resulting inclusions of the invention to be completely inhibited because of the fact that, in an oxide inclusion, there is little short-range diffusion and very limited convective movement. These inclusions, which have remained glassy in the temperature range of the hot treatments to the steel, also have a lower hardness and a lower elastic modulus than the crystallized inclusions of corresponding composition. Thus, the inclusions may be further deformed, compressed and elongated, during the drawing operation and the stress concentrations in the region of the inclusions are greatly decreased, which significantly reduces the risk, for example, of fatigue cracks appearing or breakages occurring during drawing.

According to the invention, the stainless steel contains oxide inclusions of defined composition such that their viscosity within the temperature range in which the steel is hot-rolled is not too high. Consequently, the yield stress of the inclusion is markedly lower than that of the steel under the hot-rolling conditions, the temperatures of which are generally between 800° C. and 1350° C. Thus, the oxide inclusions deform at the same time as the steel during hot rolling and therefore, after rolling, these inclusions are perfectly elongate and have a very small thickness. This avoids any problem of breakage during a drawing operation.

The inclusions described above are, according to the invention, produced using the conventional and highly efficient production means of an electric steelworks for stainless steels, such as an electric furnace, an AOD or VOD converter, in-ladle metallurgy and continuous casting.

The oxide inclusions below, having the favorable properties described, are, according to the invention, composed of a glassy mixture of $SiO_2$, MnO, CaO, $Al_2O_3$, MgO and $Cr_2O_3$, and, optionally traces of FeO and $TiO_2$, in the following proportions by weight:

$30\% \leqq SiO_2 \leqq 65\%$, $5\% \leqq MnO \leqq 40\%$, $1\% \leqq CaO \leqq 30\%$, $0\% \leqq MgO \leqq 10\%$, $3\% \leqq Al_2O_3 \leqq 25\%$, $0\% \leqq Cr_2O_3 \leqq 10\%$.

If the $SiO_2$ content is less than 30%, the viscosity of the oxide inclusions is too low and the oxide-crystal growth mechanism is not inhibited. If $SiO_2$ is greater than 65%, very hard and harmful silica particles, in the form of trydimite, cristobalite or quartz, are produced.

The MnO content, of between 5% and 40%, makes it possible to reduce greatly the softening point of the oxide mixture containing, in particular, $SiO_2$, CaO and $Al_2O_3$ and promotes the creation of inclusions which remain in the glassy state under the rolling conditions used for the steel according to the invention.

For a CaO content of less than 1%, crystals of MnO—$Al_2O_3$ or of mullite form. When the CaO content is greater than 30%, crystals of CaO—$SiO_2$ or (Ca,Mn)O—$SiO_2$ then form. For an MgO content of greater than 10%, crystals of MgO, 2MgO—$SiO_2$ or MgO—$SiO_2$ or $Al_2O_3$—MgO form which are extremely hard phases.

If $Al_2O_3$ is less than 3%, crystals of wollastonite form and when $Al_2O_3$ is greater than 25% crystals of mullite, anorthite, corundum, spinels, in particular of the $Al_2O_3$—MgO or $Al_2O_3$—$Cr_2O_3$—MgO—MnO type, or else aluminates of the CaO—$6Al_2O_3$ or CaO—$Al_2O_3$ type, or gehlenite appear.

With more than 10% $Cr_2O_3$, hard crystals of $Cr_2O_3$ or $Al_2O_3$—$Cr_2O_3$—MgO—MnO, CaO—$Cr_2O_3$ or MgO—$Cr_2O_3$ also appear.

According to one form of the invention, the sulfur content must be less than 0.010% in order to obtain sulfide inclusions having a thickness not exceeding 5 $\mu$m on rolled product. This is because the inclusions of the manganese sulfide and chromium sulfide type are completely deformable, when hot, under the following conditions:

$5\% < Cr < 30\%$ $30\% < Mn < 60\%$ $35\% < S < 45\%$

The inclusions of the oxide and sulfide type are generally regarded as being deleterious with regard to the properties for use in the field of fine-wire drawing and in the field of fatigue strength, in particular in flexure and/or torsion.

A form factor may be defined for an observed inclusion, this being the ratio of the length to the thickness. The form factor of the inclusions in the wires may be as high as 10 or 20 and, as a consequence, the thickness of the inclusion is extremely small.

These inclusions are not deleterious for applications of fine drawing into wire having a diameter of less than 0.3 mm or of components subjected to fatigue, such as springs and tire reinforcement.

The inclusion characteristics are manifested by the fact of the presence, over an area of 1000 $mm^2$ sampled from a wire rod having a diameter of greater than or equal to 5 mm, of less than 5 oxide inclusions with a thickness of more than 10 $\mu$m. The sulfide inclusions with a thickness of greater than 5 $\mu$m, over an area of 1000 $mm^2$, number less than 10.

The process according to the invention, using a steel of composition which is optimized for cold deformation and for fine-wire drawing, ensures that there is

- a weak tendency to form martensite—this is formed in a sufficient amount to harden the steel but not in a sufficient amount to cause the wire to become brittle after drawing;
- very gradual consolidation so that the tensile strength may be between 2200 MPa and 3000 MPa for a 0.18 mm drawn wire, drawn from 5.5 mm without annealing or for any other drawn wire obtained with a cumulative reduction ratio of greater than 6 without intermediate annealing;
- controlled inclusions which ensure that drawing takes place with few breakages.

The wire according to the invention can be used, in its state hardened by the strain hardening due to drawing, or else after aging heat treatment between 300° C. and 550° C., which is capable of hardening it further, by precipitation of epsilon copper, for the manufacture, for example, of springs or tire reinforcements.

It may also be subjected, in the final diameter, to a softening annealing operation and be used for the manufacture of various objects, such as woven or knitted wires, woven sheaths for hoses, filters, etc.

We claim:

1. A process for producing a drawn wire having a diameter of less than 0.3 mm by drawing a base wire rod having a diameter of greater than 5 mm or a predrawn base wire of a steel with the following composition by weight:

carbon $\leqq 40\times10^{-3}\%$ nitrogen $\leqq 40\times10^{-3}\%$, the carbon and nitrogen satisfying the relationship $C+N \leqq 50\times10^{-3}\%$, $0.2\% \leqq$ silicon $\leqq 1.0\%$, $0.2\% \leqq$ manganese $\leqq 5\%$, $9\% <$ nickel $\leqq 12\%$, $15\% \leqq$ chromium $\leqq 20\%$, $1.5\% \leqq$ copper $\leqq 4\%$, sulfur $\leqq 10\times10^{-3}\%$, phosphorus $< 0.050\%$, $40\times10^{-4}\% \leqq$ total oxygen $\leqq 120\times10^{-4}\%$, $0.1\times10^{-4}\% \leqq$ aluminum $\leqq 20\times10^{-4}\%$, magnesium $\leqq 5\times10^{-4}\%$, $0.1\times10^{-4}\% \leqq$ calcium $\leqq 5\times10^{-4}\%$, titanium $\leqq 50\times10^{-4}\%$, impurities inherent in the manufacture, in which steel the inclusions of oxides have, in the form of a glassy mixture, the following proportions by weight:

$30\% \leqq SiO_2 \leqq 65\%$, $5\% \leqq MnO \leqq 40\%$ $1\% \leqq CaO \leqq 30\%$, $0\% \leqq MgO \leqq 10\%$, $3\% \leqq Al_2O_3 \leqq 25\%$, $0\% \leqq Cr_2O_3 \leqq 10\%$.

the composition satisfying the following relationship:

when Si Mn<2%;

IM=551−462*(C %+N %)−9.2*Si %−8.1*Mn %−13.7*Cr %−29*(Ni %+Cu %)−18.5*Mo %, with

−150° C.<IM<−55° C., and when

Si Mn≧2%;

JM=551−462*(C %+N %)−9.2*Si %−20*Mn %−13.7*Cr %−29*(Ni %+Cu %)−18.5*Mo %, with

−120° C.<JM<−55° C., which base wire undergoes drawing satisfying the following drawing conditions:

a cumulative deformation ratio $\epsilon$ of greater than 6, the wire is held, during the drawing and between the drawing operations, at a temperature of less than 650° C., without annealing between the drawing passes.

2. The process as claimed in claim 1, wherein the composition includes less than $5\times10^{-3}\%$ of sulfur.

3. The process as claimed in claim 1, wherein the composition includes from 3% to 4% of copper.

4. The process as claimed in claim 1, wherein the composition furthermore includes less than 3% of molybdenum.

5. The process as claimed in claim 1, wherein a wire having a final diameter of less than 0.2 mm is drawn.

6. The process as claimed in claim 1, wherein the drawing is carried out with a cumulative deformation ratio $\epsilon$ of greater than 6.6.

7. The process as claimed in claim 1, wherein the wire furthermore undergoes a brass-plating operation before or between the drawing operations.

8. The process as claimed in claim 1, wherein the base wire having a diameter of greater than or equal to 5 mm contains less than 5 oxide inclusions with a thickness of greater than 10 $\mu$m over an area of 1000 $mm^2$.

9. The process as claimed in claim 1, wherein the base wire having a diameter of greater than or equal to 5 mm contains less than 10 sulfide inclusions with a thickness of greater than 5 $\mu$m over an area of 1000 $mm^2$.

10. A stainless steel comprising the following composition by weight:

carbon$\leqq 40\times10^{-3}\%$ nitrogen$\leqq 40\times10^{-3}\%$, the carbon and nitrogen satisfying the relationship $C+N \leqq 50\times10^{-3}\%$ $0.2\% \leqq$ silicon $\leqq 1.0\%$, $0.2\% \leqq$ manganese $\leqq 5\%$, 9%<nickel≦12%, $15\% \leqq$ chromium $\leqq 20\%$, $1.5\% \leqq$ copper $\leqq 4\%$, sulfur$\leqq 10\times10^{-3}\%$, phosphorus<0.050%, $40\times10^{-4}\% \leqq$ total oxygen $\leqq 120\times10^{-4}\%$, $0.1\times10^{-4}\% \leqq$ aluminum $\leqq 20\times10^{-4}\%$, magnesium$\leqq 5\times10^{-4}\%$, $0.1\times10^{-4}\% \leqq$ calcium $\leqq 5\times10^{-4}\%$, titanium$\leqq 50\times10^{-4}\%$, impurities inherent in the manufacture, the composition satisfying the following relationships:

when Si Mn<2%;

IM=551−462*(C %+N %)−9.2*Si %−8.1*Mn %−13.7*Cr %−29*(Ni %+Cu %)−18.5*Mo %, with

−150° C.<IM<−55° C., and when

Si Mn≧2%;

JM=551−462*(C %+N %)−9.2*Si %−20*Mn %−13.7*Cr %−29*(Ni %+Cu %)−18.5*Mo %, with

−120° C.<JM<−55° C., in which steel the inclusions of oxides have in the form of a glassy mixture, the following proportions by weight:

$30\% \leqq SiO_2 \leqq 65\%$, $5\% \leqq MnO \leqq 40\%$, $1\% \leqq CaO \leqq 30\%$, $0\% \leqq MgO \leqq 10\%$, $3\% \leqq Al_2O_3 \leqq 25\%$, $0\% \leqq Cr_2O_3 \leqq 10\%$.

11. The steel as claimed in claim 10, wherein the composition includes less than $5\times10^{-3}\%$ of sulfur.

12. The steel as claimed in claim 10, wherein the composition includes from 3% to 4% of copper.

13. The steel as claimed in claim 10, wherein the composition furthermore includes less than 3% of molybdenum.

14. A steel wire obtained by the process as claimed in claim 1, in particular a wire for reinforcing tires, having a diameter of less than 0.3 mm obtained by drawing a base wire rod having a diameter of greater than 5 mm or a predrawn base wire, which steel wire has the following composition by weight:

carbon$\leqq 40\times10^{-3}\%$ nitrogen$\leqq 40\times10^{-3}\%$, the carbon and nitrogen satisfying the relationship $C+N \leqq 50\times10^{-3}\%$, $0.2\% \leqq$ silicon $\leqq 1.0\%$, $0.2\% \leqq$ manganese $\leqq 5\%$, $9\% \leqq$ nickel $\leqq 12\%$, $15\% \leqq$ chromium $\leqq 20\%$, $1.5\% \leqq$ copper $\leqq 4\%$, sulfur$\leqq 10\times10^{-3}\%$, phosphorus<0.050%, $40\times10^{-4}\% \leqq$ total oxygen $\leqq 120\times10^{-4}\%$, $0.1\times10^{-4}\% \leqq$ aluminum $\leqq 20\times10^{-4}\%$, magnesium$\leqq 5\times10^{-4}\%$, $0.1\times10^{-4}\% \leqq$ calcium $\leqq 5\times10^{-4}\%$ titanium$\leqq 50\times10^{-4}\%$, impurities inherent in the manufacture, the composition satisfying the following relationships:

when Si Mn<2%;

IM=551−462*(C %+N %)−9.2*Si %−8.1*Mn %−13.7*Cr %−29*(Ni %+Cu %)−18.5*Mo %, with

−150° C.<IM<−55° C., and when

Si Mn≧2%;

JM=551−462*(C %+N %)−9.2*Si %−20*Mn %−13.7*Cr %−29*(Ni %+Cu %)−18.5*Mo %, with

−120° C.<JM<−55° C., in which steel the inclusions of oxides have, in the form of a glassy matrix, the following proportions by weight:

$30\% \leqq SiO_2 \leqq 65\%$, $5\% \leqq MnO \leqq 40\%$, $1\% \leqq CaO \leqq 30\%$, $0\% \leqq MgO \leqq 10\%$, $3\% \leqq Al_2O_3 \leqq 25\%$, $0\% \leqq Cr_2O_3 \leqq 10\%$, the wire having a diameter of less than 0.3 mm.

15. The steel wire as claimed in claim 14, wherein its tensile strength is greater than or equal to 2200 MPa.

16. The process as claimed in claim 2, wherein a wire having a final diameter of less than 0.2 mm is drawn.

17. The process as claimed in claim 2, wherein the drawing is carried out with a cumulative deformation ratio $\epsilon$ of greater than 6.6.

18. The process as claimed in claim 2, wherein the base wire having a diameter of greater than or equal to 5 mm contains less than 5 oxide inclusions with a thickness of greater than 10 $\mu$m over an area of 1000 $mm^2$.

19. The process as claimed in claim 3, wherein a wire having a final diameter of less than 0.2 mm is drawn.

20. The process as claimed in claim 4, wherein a wire having a final diameter of less than 0.2 mm is drawn.

21. The process as claimed in claim 1, wherein the wire is held, during the drawing and between the drawing operations, at a temperature of less than 600° C. without annealing between the drawing passes.

22. The process as claimed in claim 2, wherein the wire is held, during the drawing and between the drawing operations, at a temperature of less than 600° C. without annealing between the drawing passes.

23. The process as claimed in claim 3, wherein the wire is held, during the drawing and between the drawing operations, at a temperature of less than 600° C. without annealing between the drawing passes.

24. The process as claimed in claim 4, wherein the wire is held, during the drawing and between the drawing operations, at a temperature of less than 600° C. without annealing between the drawing passes.

25. The process as claimed in claim 5, wherein the wire is held, during the drawing and between the drawing operations, at a temperature of less than 600° C. without annealing between the drawing passes.

26. The process as claimed in claim 6, wherein the wire is held, during the drawing and between the drawing operations, at a temperature of less than 600° C. without annealing between the drawing passes.

27. The process as claimed in claim 7, wherein the wire is held, during the drawing and between the drawing operations, at a temperature of less than 600° C. without annealing between the drawing passes.

28. The process as claimed in claim 8, wherein the wire is held, during the drawing and between the drawing operations, at a temperature of less than 600° C. without annealing between the drawing passes.

29. The process as claimed in claim 9, wherein the wire is held, during the drawing and between the drawing operations, at a temperature of less than 600° C. without annealing between the drawing passes.

* * * * *

UNITED STATES PATENT AND TRADEMARK OFFICE

CERTIFICATE OF CORRECTION

PATENT NO. : 6,440,579 B1
DATED : August 27, 2002
INVENTOR(S) : Hauser et al.

It is certified that error appears in the above-identified patent and that said Letters Patent is hereby corrected as shown below:

Title page,
Item [73], Assignee, should read:

-- [73] Assignees: Ugine Savoie, Ugine;
Sprint Metal Societe
de Production Internationale
de Trefiles, Puteaux, both of (FR) --

Signed and Sealed this

Eighteenth Day of February, 2003

JAMES E. ROGAN
*Director of the United States Patent and Trademark Office*